United States Patent [19]

Hamano

[11] 4,070,024

[45] Jan. 24, 1978

[54] CONTINUOUS RACETRACK HAVING VEHICLE ACCELERATING DEVICE

[75] Inventor: Nobuo Hamano, Tokyo, Japan

[73] Assignee: Tomy Kogyo Co., Inc., Tokyo, Japan

[21] Appl. No.: 730,683

[22] Filed: Oct. 7, 1976

[30] Foreign Application Priority Data

Feb. 2, 1976 Japan ..... 51-11135[U]

[51] Int. Cl.[2] ..... A63F 9/14

[52] U.S. Cl. ..... 273/86 D; 46/206

[58] Field of Search ..... 273/86 R, 86 B, 86 D, 273/86 F; 46/202, 206, 1 K

[56] References Cited

U.S. PATENT DOCUMENTS

| | | | |
|---|---|---|---|
| 3,590,524 | 7/1971 | Beny | 273/86 D UX |
| 3,636,651 | 1/1972 | Lohr et al. | 46/202 X |
| 3,667,672 | 6/1972 | Kennedy et al. | 273/86 R X |
| 3,751,847 | 8/1973 | Neuhierl | 46/1 K |

FOREIGN PATENT DOCUMENTS

| | | | |
|---|---|---|---|
| 2,110,253 | 10/1972 | Germany | 46/202 |
| 2,148,830 | 4/1973 | Germany | 46/202 |

*Primary Examiner*—Anton O. Oechsle
*Attorney, Agent, or Firm*—Staas & Halsey

[57] ABSTRACT

A continuous racing game consisting of a trackway provided with separate paths along which vehicles race, a propulsion system having pluralities of resilient spokes associated with each of the paths, each of the pluralities of spokes being mounted for rotation and having a series of spokes radially oriented such that the ends of the spokes extend into the paths, and a mechanism for moving each of the pluralities of spokes closer to the surface of the trackway in response to a remote control signal generated by a bellows-like mechanism.

6 Claims, 5 Drawing Figures

CONTINUOUS RACETRACK HAVING VEHICLE ACCELERATING DEVICE

BACKGROUND AND SUMMARY OF THE INVENTION

The present invention relates generally to the class of toys simulating the racing of automobiles, and more particularly features a plurality of vehicles which continuously race and from time to time change positions relative to each other. The propulsion mechanism consists of a plurality of rotating, resilient spokes which engage and thereafter propel the vehicles along their separate racing paths. Moreover, there is provided within the propulsion mechanism an accelerating device for each rotating set of spokes which permit each player to adjust the position of the spokes corresponding to his racing vehicle to provide for tighter engagement between the spokes and the vehicle to cause the vehicle to leave the propulsion unit at a higher velocity than it normally leaves. The accelerating mechanism associated with each set of spokes is activated by a bellows-like mechanism.

DESCRIPTION OF THE PREFERRED EMBODIMENT

Figure 1:
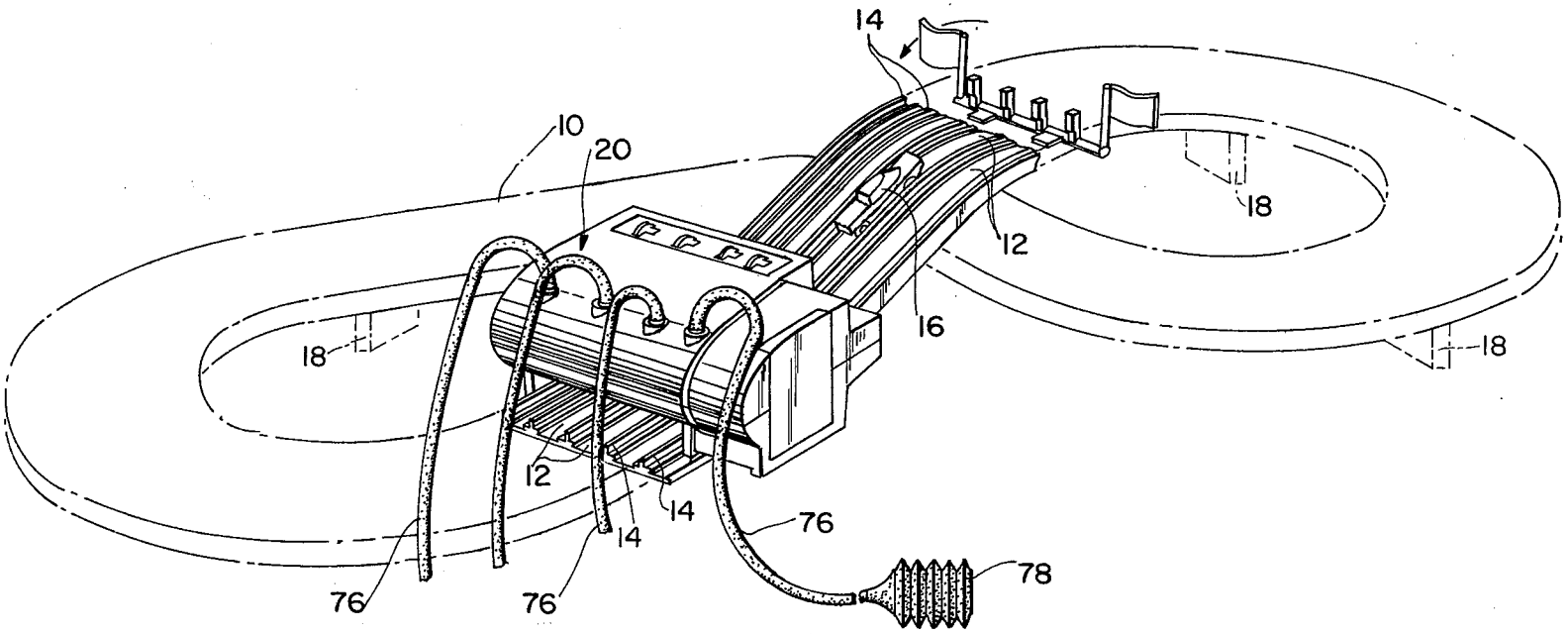
FIG. 1 is a perspective view of the continuous racetrack of the present invention, illustrating the centrally disposed propulsion unit provided with the individually operated bellows units extending therefrom which are used to accelerate the vehicles emerging therefrom.

The continuous racing toy of the present invention, as illustrated in FIG. 1, consists of a trackway designated by the reference numeral 10 which may, for example, consist of a plurality of sections with appropriate means for connecting same to each other as is well known in the art. All portions of the trackway 10 are provided with four separate racing paths 12 defined between the upstanding walls 14. It will be apparent that each of the vehicles 16, of well known construction, races within one of the separated paths 12. To achieve the desirable changes in elevation of the trackway 10 a plurality of supports 18 of differing height are employed.

Figure 2:
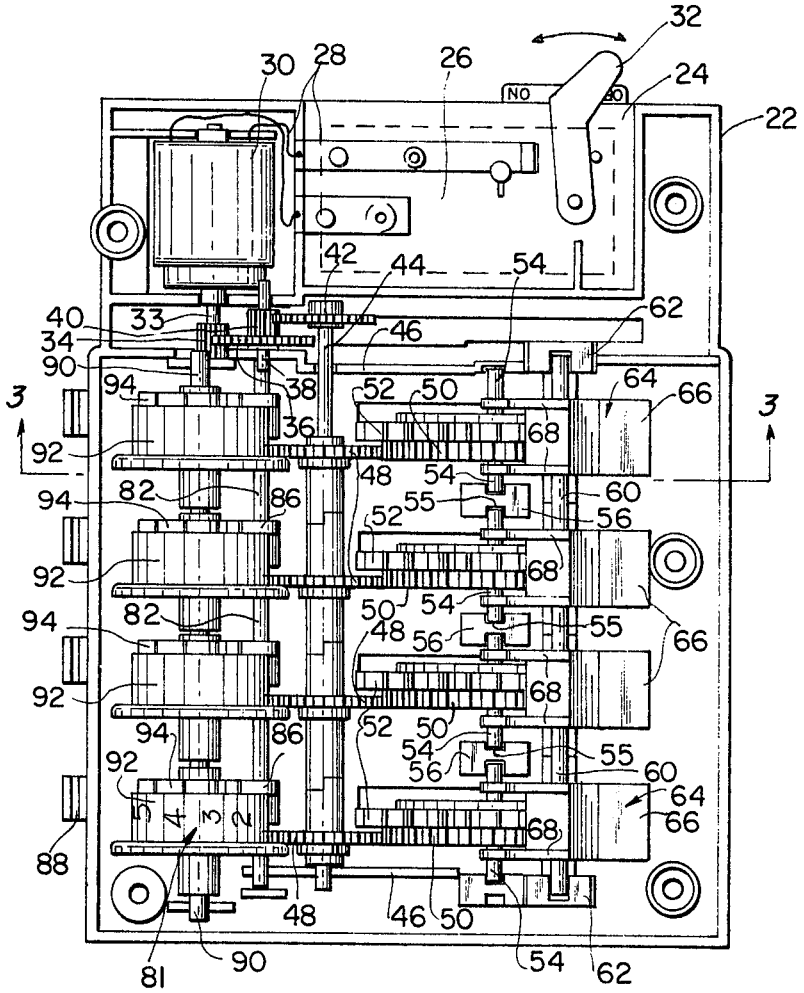
FIG. 2 is a top plan view of the propulsion unit with a section of the casing thereof removed so as to expose the internal working mechanism thereof.
Figure 3:
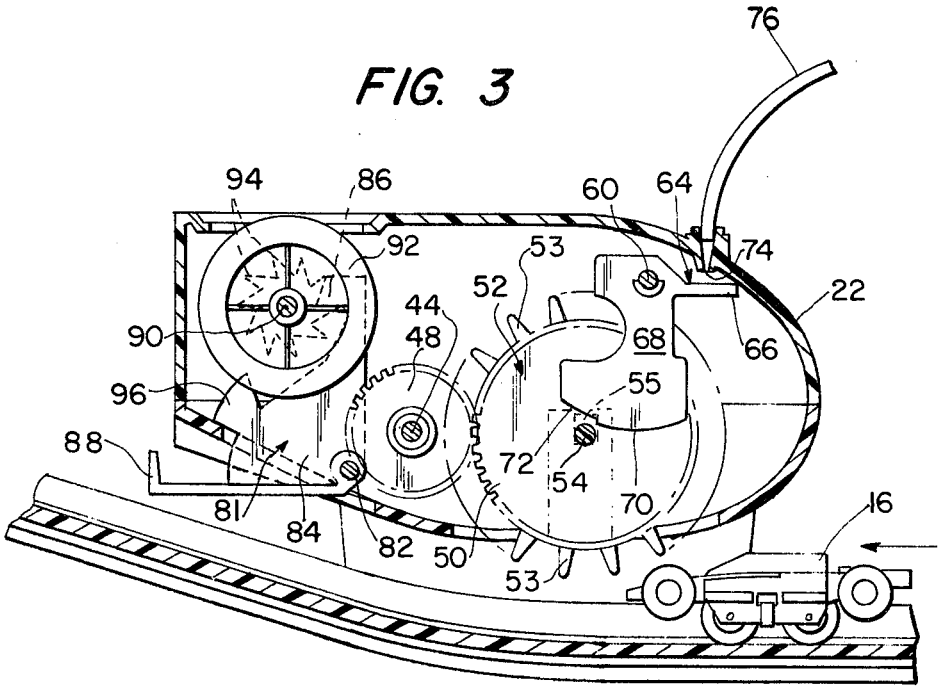
FIG. 3 is a cross-sectional view taken along line 3—3 of FIG. 2 illustrating the position and relationship of the operating mechanisms of the propulsion unit, including the rotating spoke assemblies which engage the vehicles and the associated counting mechanisms in their respective positions prior to the vehicles entering the propulsion unit.

The propulsion and counting unit designated generally by reference numeral 20, as illustrated in FIGS. 2–3, consists of a casing 22 within which the operating mechanisms are mounted. Within a housing 24 provided in the casing 22 there are located batteries 26 which by means of conventional circuitry 28 are connected to a miniature electric motor 30 of conventional design. Thus, as the switch 32 is operated the motor 30 is energized.

The shaft 33 of the motor 30 is provided with a gear 34 which meshes with a gear 36 which is mounted on a shaft 38 that is appropriately journalled for rotation with respect to a wall of the casing 22. The shaft 38 is also provided with a gear 40 which meshes with a gear 42 that is mounted on a shaft 44 which is appropriately journalled within the walls 46 of the casing 22.

Fixedly secured to the shaft 44 are a plurality of gears 48 which mesh with corresponding gear wheels 50. Each of the gear wheels 50 is provided with a resilient spoke assembly 52, the purpose of which will be explained in detail hereinafter. Each of the gear wheels 50 is securely mounted upon a shaft 54 the ends of which are appropriately journalled within cavities 55 defined by the walls 56 of the casing 22. That is to say, each of the gear wheels 50 is mounted upon a separate shaft 54 which is mounted for rotation such that each of its gear wheels 50 rotates independently. It will be apparent from FIG. 3 that because the walls 56 are provided with the slotted cavities 55 within which the shafts 54 are located, the shafts 54 and their gear wheels 50 are free to move upwardly and downwardly, the purpose of which will be described in detail hereinafter.

As also seen in FIG. 2, a shaft 60 is appropriately journalled within the walls 62 of the casing 22, and a plurality of operating mechanisms designated by the reference numeral 64 are mounted for rotation with respect to the shaft 60. It will be apparent from FIGS. 2–3 that each of the operating mechanisms 64 is provided with a flange 66 at one end thereof and two depending arms 68 the bottom portions thereof being provided with cam-like surfaces consisting of a lower surface 70 and an upper surface 72. It will be apparent from FIG. 3, therefore, that as pressure is applied to the flange 66 of one of the operating mechanisms 64 the depending arms 68 are caused to rotate from the position illustrated in FIG. 3 to the position illustrated in FIG. 5 during which time a downward force is applied to the shaft 54 as a result of the shaft 54 disengaging from contact with the upper surface 72 and becoming engaged with the lower surface 70. An opening 74 is provided in the top of the housing 22 above each of the flanges 66 and a flexible hose 76 is attached to the housing 22 so as to be in communication with the opening 74. A bellows-like mechanism 78 is attached to the other end of the hose 76 and when depressed is responsible for forcing air through the opening 74 against the flange 66. It will be apparent that there are four bellows-like mechanisms 78 corresponding to the four operating mechanisms which correspond to the four spoke assemblies 52.

Figure 4:
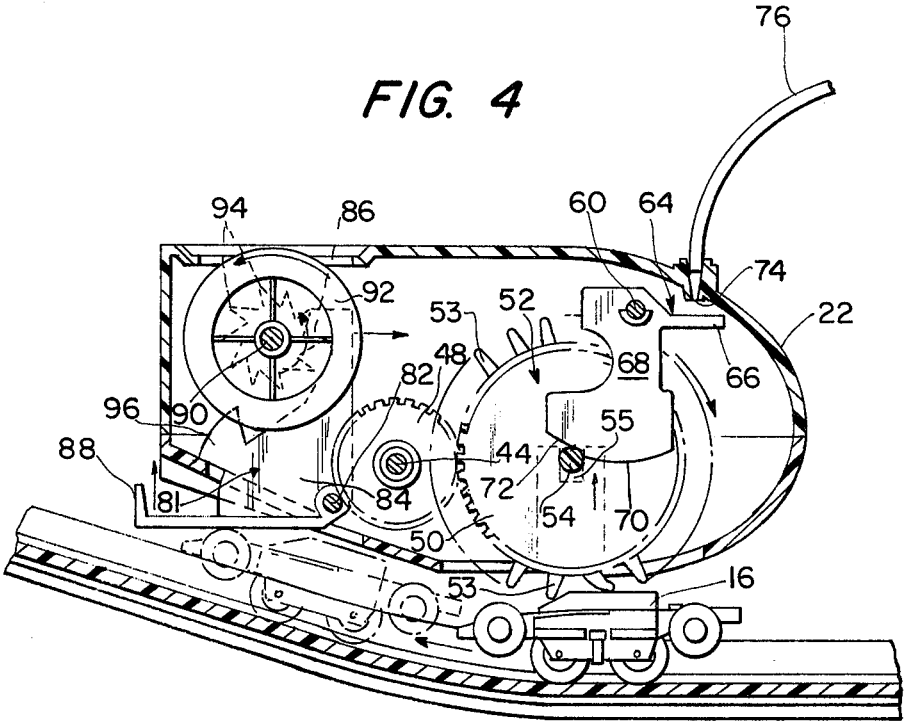
FIG. 4 is a cross-sectional view taken along line 3—3 of FIG. 2 illustrating the position of one of the rotating spoke assemblies engaging a vehicle passing therethrough when the bellows-mechanism is inoperative and also the interaction between the vehicle and the counting mechanism.

The operation of the accelerating mechanism of the propulsion unit of the present invention will now be described. It will be apparent that as the motor 30 is energized the rotation of the gears 34, 36 and 40 is responsible for rotating the gear 42 which, in turn, rotates the shaft 44 to which the gears 48 are attached. More particularly, the counter-clockwise rotation of the gear 34, as seen in FIG. 2, results in the counterclockwise rotation of each of the gears 48 which, in turn, mesh with the corresponding gears 50 causing same to rotate in a clockwise direction. It will be apparent from FIGS. 3–4 that as each of the vehicles 16 moving along its own separate path 12 enters the propulsion unit 20 the individual, resilient spokes 53, which may be made of any flexible material, for example, plastic, engage the top portion of the vehicle 16 abruptly propelling same forwardly, as illustrated in FIG. 4. It will be apparent that the engagement of the spokes 53 against the top portions of the vehicle 16 pushes the shaft 54 upwardly into engagement against the upper surface 72 of the depending arms 68.

Figure 5:
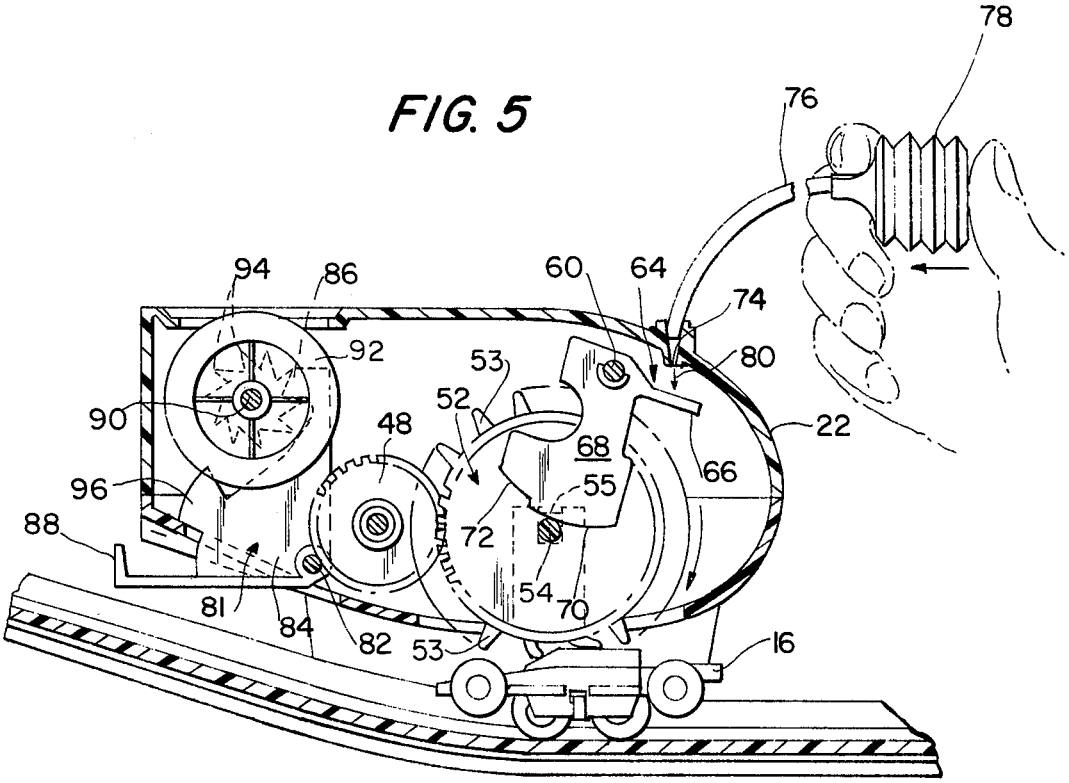
FIG. 5 is a cross-sectional view taken along line 3—3 of FIG. 2 illustrating operation of the bellows-mechanism which causes the rotating spoke assemblies associated with the vehicles to move downwardly providing for tighter engagement between the spokes and the vehicle passing therethrough resulting in accelerating the motion of the vehicle beyond the normal acceleration achieved where the bellows-like mechanism is not operated.

To increase the degree of acceleration achieved by the engagement of the rotating spokes 53 and the vehicle 16, as illustrated in FIG. 4, the bellows-mechanism 78 corresponding to the vehicle 16 entering the propulsion unit 20 is operated in the manner illustrated in FIG. 5, the result of which is to expel air through the openings 74 located immediately above the flanges 66. It is to be understood, of course, that there is a separate bellows-mechanism 78 associated with each of the separate operating mechanisms 64 which correspond to the separate gear wheels 50 which in turn correspond to the individual vehicles 16. The jet of air, designated by the reference numeral 80 in FIG. 5, exerts a downward force against the flange 66 causing the operating mechanism 64 to rotate about the shaft 60 which in turn causes the lower surface 70 of the depending arms 68 to engage the shaft 60 urging same downwardly within the slotted cavities 55 in turn forcing the gear wheel 50 downwardly, the result of which is to move the spoke assembly 52 downwardly increasing the force applied by the spokes 53 to the vehicle 16 so as to impart greater acceleration to the vehicle 16 than is achieved in the mode of operation illustrated in FIG. 4 wherein the bellows-mechanism 78 is not operated. The vehicles 16 accelerate more when the bellows-like mechanism 78 is operated since the position of the spoked assembly 52 relative to the vehicle 16 is lowered, thus increasing the force applied by the spokes 52 to the vehicle. It will be apparent, therefore, that the resilient spokes 53, in defining an irregular or non-circular periphery, permit the individual spokes or fingers 53 to bend varying degrees, such as illustrated in FIGS. 4-5, the result of which is to permit different forces to be applied to the top of the vehicle 16. From the foregoing, it will be apparent that the purpose of the separate bellows-mechanisms 78, which may be color coordinated with the colors of the vehicles 16, is to attempt to give the vehicle of each of the players added acceleration when leaving the propulsion unit 20. Accordingly, the players compete in attempting to operate their bellowsmechanism 78 at precisely the right time, namely, when their vehicle is just ready to move under the spoked assemblies 52.

The counting mechanism 81 is responsible for displaying the number of laps each vehicle 16 has made around the track and is illustrated in FIGS. 2 and 3 wherein it will be apparent that a shaft 82 is appropriately journalled within the walls 46 of the housing 22. A plurality of lever mechanisms 84 are mounted for rotation about the shaft 82. One end of each of the lever mechansims 84 is provided with a hook end 86 while the other end thereof is provided with an engaging portion 88. Intermediate the end 86 and the engaging portion 88 there is provided a tooth 96.

A second shaft 90 is also journalled within the walls 46 of the housing 22 and independently mounted for rotation thereon are a plurality of cylinders 92. Each of the cylinders 92 on one side thereof is provided with a plurality of teeth 94 arranged generally to travel in a path within the reach of the hook end 86 and the tooth 96 of the lever mechanism 84.

Turning now to FIG. 4, it will be apparent that as one of the vehicles 16 passes along its path 12 the top of the vehicle 16 eventually contacts the engaging portion 88 moving same such that the lever mechamism 84 rotates about the shaft 82. During this rotation, the tooth 96 meshes with adjacent of the teeth 94 of the cylinder 92 causing the cylinder 92 to rotate in a counterclockwise direction, as illustrated in FIG. 4. After the vehicle 16 has passed through the counting mechanism 81, the engaging portion 88 drops downwardly causing the lever mechanism 84 to rotate in a counter-clockwise direction at which time the hook end 86 of the lever mechanism 84 engages the teeth 94 of the cylinder 92 adjacent thereto causing the cylinder 92 to rotate still further in a counter-clockwise direction. This completes one counting step, and as will be apparent from FIG. 2 results in displaying the next number in sequence. In this manner, the number of laps each of the vehicles 16 has completed is registered.

I claim:

1. A continuous racing game, comprising:

a trackway;

means defining separate paths within said trackway;

a vehicle associated with each of said paths;

propulsion means for applying force to said vehicles to propel same along said paths, including pluralities of resilient spokes corresponding to said paths, the spokes of each of said pluralities being arranged to extend in a radial direction into each of said paths to engage said vehicle in said path to propel same along said path, and means rotating said resilient spokes; and additional propulsion means operable in conjunction with said propulsion means for applying still further force to said vehicles individually and in response to remote signals the players, said additional propulsion means including a shaft associated with each of said pluralities of said spokes, means mounting said pluralitites of said spokes to said shafts, means permitting said shafts to move in relation to said paths so as to permit said pluralitites of said spokes associated therewith to move toward their associated path, and operating mechanisms associated with said pluralities of said spokes, means mounting said operating mechanisms for rotation, camlike surfaces provided on said operating mechanisms and resting in engagement against said shafts such that as said operating mechanisms are rotated said cam-like surfaces urge said shafts toward said paths such that in response to said remote control signal each of said pluralities of said spokes moves closer to its associated path to apply additional force to said vehicles.

2. A continuous racing game as in claim 1, including means associated with each of said paths for counting and visually recording the number of times each of said vehicles has traversed said trackway.

3. A continuous racing game as in claim 1, wherein said means rotating said resilient spokes comprises a motor and a source of energy operatively connected thereto, means mounting each of said pluralitites of spokes for rotation independently of each other, and means operatively connecting said motor to each of said pluralities of spokes.

4. A continuous racing game as in claim 1, further comprising a flange provided on each of said operating mechanisms, a bellows associated with each of said pluralities of said spokes, and conduit means connecting said bellows to positions near said flanges such that when said bellows are operated air is expelled from said conduit means against said flanges causing said operating mechanisms to rotate.

5. A continuous racing game as in claim 4, including a casing within which said propulsion and additional propulsion means are mounted, and openings within said casing above said flanges, said conduit means being connected to said openings.

6. A racing game, comprising a trackway provided with paths along which vehicles travel, propulsion mechanisms associated with said paths and having shafts mounted for rotation and for movement toward and away from said paths, a plurality of resilient spokes associated with and operatively connected to each of said shafts, means continuously rotating said shafts and said resilient spokes associated therewith such that portions of said resilient spokes engage said vehicles imparting forces thereto to propel same, means associated with each of said shafts and responsive to the force of air to selectively move said shafts toward their associated paths to move said resilient spokes closer to said paths such that additional portions of said resilient spokes engage said vehicles imparting additional forces to said vehilces propelling same including operatively mechansims associated with said shafts and mounted for movement, cam-like surfaces provided on said operating mechanisms and resting in engagement against said shafts such that as said operating mechansims are moved said cam-like surfaces urge said shafts toward said paths, and flanges, and bellows mechanisms associated with said propulsion mechansims and operable to direct air against said flanges.

* * * * *